US006856242B2

(12) United States Patent
Trent

(10) Patent No.: US 6,856,242 B2
(45) Date of Patent: Feb. 15, 2005

(54) AUTOMATIC SIREN SILENCING DEVICE FOR FALSE ALARMS

(75) Inventor: Robert J. Trent, Burnaby (CA)

(73) Assignee: Spiral Technologies Ltd., Burnaby (CA)

( * ) Notice: Subject to any disclaimer, the term of this patent is extended or adjusted under 35 U.S.C. 154(b) by 129 days.

(21) Appl. No.: 10/357,207

(22) Filed: Feb. 4, 2003

(65) Prior Publication Data

US 2004/0160316 A1 Aug. 19, 2004

(51) Int. Cl.[7] ..... G08B 3/00
(52) U.S. Cl. ..... 340/384.1; 340/309.9
(58) Field of Search ..... 340/384.1, 309.9, 340/514, 515, 567, 628

(56) References Cited

U.S. PATENT DOCUMENTS 4,568,924 A * 2/1986 Wuthrich et al. ..... 340/587
4,630,684 A * 12/1986 Cinzori et al. ..... 169/46
4,764,755 A * 8/1988 Pedtke et al. ..... 340/541
5,093,656 A * 3/1992 Dipoala ..... 340/522
5,815,066 A * 9/1998 Pumilia ..... 340/309.9

* cited by examiner

*Primary Examiner*—John Tweel

(57) ABSTRACT

An automatic siren silencing device for false alarms, for use in an alarm system having a siren driver which powers a siren. A microcomputer monitors pulse signal characteristics of the siren driver, including duration of pulses and number of pulses, and compares these characteristics with predetermined pulse signal characteristics stored in a memory. A relay coil is energized by the microcomputer, controlling a relay switch which disconnects the siren from the siren driver when the pulse signal characteristics are indicative of a false alarm thereby silencing the siren. A user means is provided to adjust the predetermined pulse signal characteristics. Power to the microcomputer is provided by a capacitor, charged by the signal of the siren driver, whereby no battery or dedicated external power supply input is required. Indicator lights and a piezo element inform a user of siren silencing, and indicate the types of false alarms detected.

35 Claims, 9 Drawing Sheets

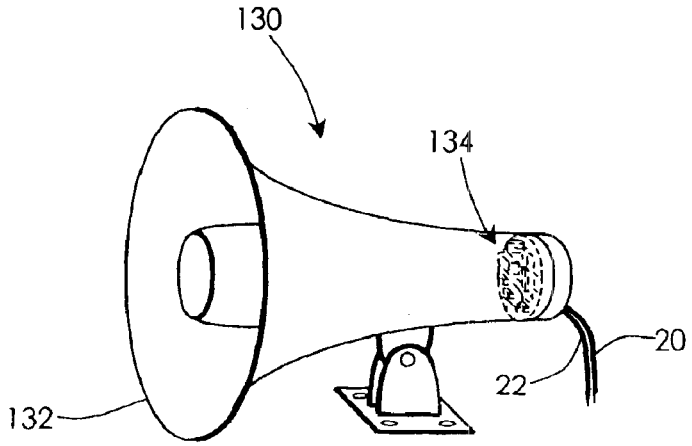

FIG. 5

140

SIREN SILENCING DEVICE SETUP

142 False Alarm Type 1 – Siren sounds for a period of time, then goes silent for a very short period of time, and repeats this sequence indefinitely:

144 Enter minimum number of consecutive triggerings required: 03 triggerings.

146 Enter minimum total time from first triggering required: 06 minutes, 00 seconds.

148 Enter max silent time allowed between triggerings: 00 minutes, 10 seconds.

150 False Alarm Type 2 – Siren continuously on:

152 Enter minimum total time siren on required: 15 minutes, 00 seconds.

160 False Alarm Type 3/4 – Siren sounds for a period of time, then goes silent for an extended period of time, and repeats this sequence intermittently:

162 Enter minimum number of triggerings required: 04 triggerings.

164 Enter time window in which triggerings must occur: 08 hours, 00 minutes.

166 Enter minimum silent time allowed between triggerings: 00 minutes, 10 seconds.

168 Enter delay until each new siren sounding is silenced: 00 minutes, 15 seconds.

FIG. 6

AUTOMATIC SIREN SILENCING DEVICE FOR FALSE ALARMS

CROSS-REFERENCE TO RELATED APPLICATIONS

Not applicable.

BACKGROUND

1. Field of the Invention

The present invention relates to alarm systems and more particularly to a device specifically designed to automatically disrupt power to an alarm system's siren when the alarm system is generating false alarms.

2. Description of Prior Art

Alarm systems are commonly used in automobiles, homes, and businesses. They are generally installed with the intention of discouraging break-ins by ensuring that a criminal's illegal act will be quickly detected and brought to the attention of property owners, neighbors, and/or authorities within the community.

Once an alarm system is triggered, or detects a break-in, it typically sounds an audible alert from a siren. Most alarm systems include a timer that automatically resets the triggered alarm system after a predetermined period of time, silencing the siren. Communities are often very sensitive to noise pollution, especially in high-density urban environments, and it is expected that alarm systems will only sound their sirens for a limited period of time.

False alarms, defined as the alarm system's siren sounding an audible alert when there is no actual break-in in progress, are an ongoing problem. Most prior art attempts to reduce the occurrence of false alarms by improving the reliability of the alarm system's sensors or by carefully analyzing data from sensors in an attempt to determine the legitimacy of the break-in detection. But in spite of these efforts false alarms are still common. So many factors contribute to false readings from sensors that it is difficult to ever completely eliminate false alarms. Such factors may include changes to temperature, humidity, moisture, pressure, background noise, or other environmental factors. Corrosion on contacts or connectors, lightning strikes, or component degradation within the system may cause a sensor or alarm system's processing unit to trigger an alarm. Improperly calibrated sensors or incorrect alarm installation, as well as other human error, may also contribute to false alarms.

Once the siren is activated, the alarm system relies on the timer to automatically reset the triggered alarm system after a predetermined period of time. But four types of commonly occurring false alarms have the potential of causing the alarm system's siren to sound for an extended, and unreasonable, amount of time, even if the reset timer is present. These false alarms force neighbors to endure loud noise pollution from the siren, as they have no recourse in silencing the siren other than calling the police, who may forcibly silence the offending siren. In many communities, a car owner with this type of malfunctioning alarm may have his car towed while homeowners may be faced with a fine for requiring police attendance. In either case, the false alarm has the potential of costing the alarm owner money.

Type-1 False Alarm and Prior Art Prevention

The first type of false alarm that causes extended sounding of the siren is referred to as a type-1 false alarm in this discussion. It is characterized by a malfunctioning sensor that repeatedly and continuously outputs a change of state, indicating a break-in detection. Once the alarm system has sounded its siren for a period of time and has automatically reset itself, this malfunctioning sensor will immediately cause the alarm system to be retriggered, resulting in the siren sounding once again. The alarm system's automatic reset does not prevent the false alarm and the extended sounding of the siren. This type of false alarm is commonly encountered in car alarms and home alarms that can be heard repeatedly sounding a siren for several minutes, going silent for a second, sounding the siren again for several minutes, then going silent for a second. The alarm system will continue this noise pollution until the owner returns to disarm the alarm system or the malfunctioning sensor stops sending repeated change of state signals.

Some alarm systems have processing units with more advanced sensor output comparison and analysis capabilities that have the ability to detect this type of malfunctioning sensor and ignore it, a feature known as automatic sensor bypass. Although this feature may help to prevent this type of false alarm, it is generally only found in very expensive alarm systems, as it requires special analysis of every sensor signal entering the alarm system's processing unit. Automatic sensor bypass also requires dedicated wiring to every sensor in the alarm system, rather than connecting sensors on common normally-open or normally closed wire loops. Finally, for existing alarm system owners the addition of automatic sensor bypass to reduce false alarms requires a complete upgrade of the alarm system, which is both expensive and time-consuming.

Type-2 False Alarm and Prior Art Prevention

The second type of false alarm that causes extended sounding of the siren, referred to as a type-2 false alarm in this discussion, is a malfunctioning alarm system's processing unit. Even though the processing unit may be carefully designed to run reliably, and may include an automatic alarm system reset circuit and automatic sensor bypass, it may still malfunction due to any number of environmental factors or functional failures. For example, the mechanical relay responsible for switching on the siren may fail or moisture may disrupt the proper function of the processing unit's electronics. It is possible for an alarm system's processing unit to enter into and remain in the triggered state. This type of failure results in the alarm system's siren turning on and indefinitely remaining steadily on.

Type-3 False Alarm and Prior Art Prevention

The third type of false alarm that causes extended sounding of the siren, referred to as a type-3 false alarm in this discussion, is a sensor that repeatedly yet intermittently indicates a change of state. This is similar to the type-1 false alarm described above, except in this case the sensor outputs a change of state to the processing unit intermittently rather than continuously. This type of false alarm is often due to an improperly calibrated sensor, such as a car alarm system's vibration sensor calibrated to be too sensitive. In this example, every time a truck drives by the vibration sensor, the alarm system enters the triggered state and the siren sounds.

This false alarm is very common and can be identified by the siren sounding for a period of time, such as several minutes, followed by an extended period of silence, such as 20 minutes, followed again by several minutes of the siren sounding. Environmental conditions can contribute to an improperly calibrated sensor that generated this type of false alarm. Other improper alarm installation procedures, such as accidentally aiming a motion detector outside where passersby cause the alarm to enter the triggered state, may also contribute to this type of false alarm. Even highly reliable sensors and the inclusion of an automatic alarm reset circuit and automatic sensor bypass don't prevent an alarm system from generating this type of false alarm.

Type 4 False Alarm and Prior Art Prevention

The fourth and final type of false alarm that causes extended sounding of the siren, referred to as a type-4 false alarm in this discussion, is alarm system user error. One very common form of this type of false alarm involves accidental arming of the motion detectors within a building when occupants are present. It is common for a home alarm system to include both perimeter sensors, such as window and door magnetic reed switches, and interior motion detectors. These two types of sensors can often be separately armed. The advantage to this capability is to permit movement within the house while still protecting the perimeter against break-ins.

However, consider a homeowner who accidentally arms both the perimeter and interior motion sensors of a home when a pet is in the house, then leaves the premises. The movements of the pet throughout the house will cause the alarm system to repeatedly yet intermittently enter the triggered state, and sound the alarm system's siren. For neighbors, the siren sounding characteristics of this type of false alarm are identical to those of the type-3 false alarm; the siren sounds repeatedly yet intermittently. Because type-3 and type-4 false alarms demonstrate the same siren sounding characteristics, these two types of false alarms are collectively referred to as a type-3/4 false alarm in this discussion. It is not uncommon for alarm system owners to learn, from neighbors, that their alarm system repeatedly sounded throughout the day or night because of the accidental triggering of motion sensors while a pet was left alone in the home. Once again, improved sensor reliability, the inclusion of an automatic alarm reset circuit, and automatic sensor bypass don't prevent an alarm system from generating this type of false alarm.

Summary

All four types of false alarms described above have the potential of causing the alarm system's siren to sound for extended periods of time. Even with the many improvements to sensor reliability, and the inclusion of an automatic alarm system reset circuit, these four types of false alarms are still common and unresolved. An otherwise reliable alarm system can one day unexpectedly generate any one of these types of false alarms. Alarm owners, conscious of disturbing neighbors or incurring fines for such false alarms, are discouraged from always arming their alarms when they aren't present. This leaves their property unprotected. Other users elect to eliminate the alarm's siren altogether and communicate an alarm system triggering to remote monitoring services via radio or telephone links. Without a siren, a criminal may not be scared away from property that the alarm system is designed to protect.

SUMMARY OF THE INVENTION

The present invention is a device that connects directly to the wire running between an alarm system and its siren. Under normal conditions, the device allows the alarm system's siren output to drive the siren. But when the device detects that the siren has been sounding for an extended period of time or has been sounding repeatedly, an indication of a false alarm, it automatically disconnects the siren from the alarm system's output, silencing the siren. In doing so, disturbance to a neighborhood is reduced during false alarms.

OBJECTS AND ADVANTAGES OF THE INVENTION

Primary Advantages

It is an object of the present invention to provide a device that reduces the duration and frequency that an alarm system's siren sounds during false alarms and thereby reduces the noise pollution endured by neighbors. The siren silencing device automatically disconnects a siren, or several sirens, from the alarm system once the siren has sounded for an extended period of time or has sounded repeatedly.

It is a further object of the present invention to detect the first type of false alarm described in the background of prior art and silence the siren. This type-1 false alarm is characterized by a siren that sounds for a period of time, then goes silent for a very short period of time, and repeats this sequence indefinitely. Other false alarm prevention techniques have difficulty in preventing this type of false alarm.

It is a further object of the present invention to detect the second type of false alarm described in the background of prior art and silence the siren. This type-2 false alarm is characterized by a siren that sounds continuously for an extended period of time. Other false alarm prevention techniques have difficulty in preventing this type of false alarm.

It is a further object of the present invention to detect the third and fourth types of false alarms described in the background of prior art and silence the siren. This type-3/4 false alarm is characterized by a siren that sounds repeatedly yet intermittently. As an alternative to immediately silencing the siren, upon detection, the present invention may allow the siren to sound for a short period of time at the beginning of each new siren sounding for these two types of false alarms. This ensures that neighbors and authorities are warned of the new alarm system triggering in the event that it represents a legitimate break-in. Other false alarm prevention techniques have difficulty in preventing this type of false alarm.

It is a further object of the present invention not to disrupt the sounding of the siren during normal operation of the alarm system. If an actual break-in is detected by the alarm system, the present invention will allow the alarm system to function properly and sound the siren. The siren silencing device will disconnect the siren only after the siren has been sounding for an extended period of time or has been sounding repeatedly. It is expected that, before this silencing occurs, neighbors and/or authorities would have already had an opportunity to respond appropriately to a legitimate alarm.

It is a further object of the present invention to allow the alarm system to return to a fully functional state by automatically reconnecting the siren to the alarm system after a false alarm has ended. This allows subsequent legitimate break-ins to properly sound the alarm system's siren.

It is a further object of the present invention that the siren silencing device is easily added to most existing alarm systems, including home, business, and car alarms. Alarm owners are not forced to replace major components of their alarm system or perform major alterations in order to install the present invention. The siren silencing device is not intended to replace other false alarm prevention inventions and techniques. It is to be added to existing alarm systems to further decrease the probability of false alarms that produce extended or repeated siren soundings.

It is a further object of the present invention that the siren silencing device requires no battery or dedicated power input to operate. No device maintenance is required and the device can be easily connected anywhere on the wire running between the alarm system and the siren and does not have to be located near a power outlet.

Other Advantages

It is a further object of the present invention that the siren silencing device includes a means for alarm installers and/or operators to adjust and customize certain parameters of the device in the field. These parameters define siren switching characteristics, such as duration and number of siren soundings, until silencing occurs.

It is a further object of the present invention that the siren silencing device may be physically separated and distinct from the alarm system to which it is attached. If the alarm system is affected by environmental conditions or operational malfunction, causing a false alarm, the siren silencing device may not experience these conditions and will still operate properly and silence the siren during a false alarm.

It is a further object of the present invention that the siren silencing device is designed in a manner that will protect it from most common environmental hazards found inside buildings and automobile passenger compartments. These hazards include moisture, temperature, and vibration extremes as well as lightning storm voltage spikes. It will tolerate accidental reverse polarity hook up and the overvoltage encountered when jumper cables are connected improperly between two automobiles. This durability is required to ensure that the product has a long, useful life and can be depended on to reliably accomplish its intended function without regular maintenance.

It is a further object of the present invention that the siren silencing device produces an audible tone and indicator light to inform an alarm operator that the device is currently silencing the siren. This signal will allow an alarm operator to recognize that the alarm system is currently triggered and generating a false alarm. This will allow the operator to take appropriate measures, such as disarming the alarm system and having it serviced.

It is a further object of the present invention that the siren silencing device produces an audible tone and indicator light for an extended period after the device last silenced the siren. This informs an alarm operator that the alarm system recently malfunctioned, producing a false alarm with an extended siren sounding, and had its siren silenced by the present invention. With this knowledge an operator could then take appropriate action, such as testing and servicing the alarm system.

It is a further object of the present invention that the siren silencing device includes a user means to stop the present invention from silencing the siren. This may be useful when an alarm operator is present and wants the siren to continue sounding for an extended period of time, for purposes such as directing police to the break-in location.

It is a further object of the present invention that the siren silencing device includes a user means to turn off the audible tone and/or indicator light that is used to indicate recent false alarm detection. Once an operator determines that there was a recent false alarm, it is desirable to turn off these indicators.

It is a further object of the present invention that the siren silencing device includes an auxiliary normally-open and/or normally-closed feedback connector that changes state when the present invention is in the process of silencing a siren. This feature allows an alarm installer to use the present invention to feed back a reset signal to the alarm system, signal remote operators, or turn on alternative indicators during a false alarm. Alarm installation experts can determine other useful applications for this auxiliary connector.

It is a further object of the present invention that the siren silencing device may be manufactured and sold inexpensively, providing a cost-effective means to reduce siren soundings during false alarms.

It is a further object of the present invention that the siren silencing device may be integrated into a warning horn or alarm system during manufacturing, and sold as a combined product rather than be sold as an individual alarm accessory.

Further objects and advantages of my invention will become apparent from consideration of the drawings and ensuing description.

BRIEF DESCRIPTION OF THE DRAWINGS

For a better understanding of the invention, reference is made to the following detailed description and operation of the present invention which is to be read and understood in conjunction with the accompanying drawings herein. In the drawings, closely related figures have the same number but different alphabetic suffixes:

FIG. 5 is a perspective view of an integrated warning horn alternate embodiment of the present invention;

FIG. 6 is a representation of a captured frame of a computer screen used to set a plurality of software operational parameters of the invention;

REFERENCE NUMERALS IN THE DRAWINGS

Figure 1:
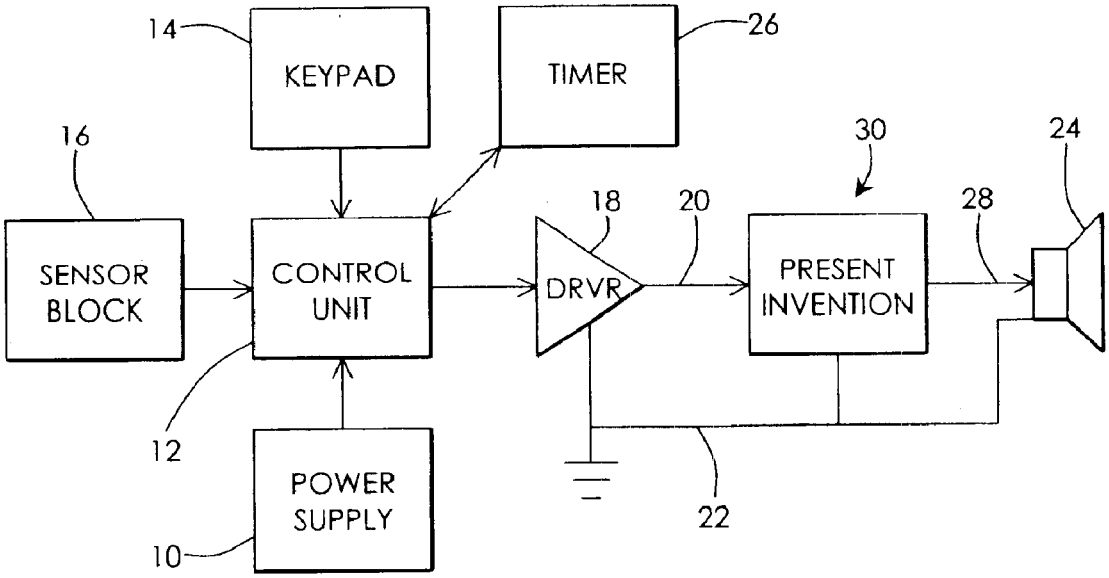
FIG. 1 is a block diagram of a conventional alarm system with the present invention installed.

10 power supply
12 control unit
14 keypad
16 sensor block
18 siren driver
20 siren driver power signal
22 ground signal
24 siren
26 timer
28 siren power signal
30 block representation of the invention
40 basic box type configuration
44 four-pin alarm system connector
46 mounting holes
50 enhanced box type configuration
52 indicator light
54 reset button
56 three-pin auxiliary connector
60 signal NO
62 signal AUX
64 signal NC

66 further enhanced box type
68 universal serial bus connector configuration
70 parameter adjustment keypad
72 liquid crystal display
74 power connector
76 battery compartment
80 relay coil
82 relay
84 relay switch
86 voltage regulator
88 fixed voltage power signal
90 diode
92 system power signal
94 large capacitor
96 microprocessor
98 transistor
100 relay control signal
102 base resistor
110 tone generator
112 second relay switch
120A charged capacitor power supply
120B long-life battery
120C rechargeable battery
120D external power block
122 communications interface
124 jumper block
130 integrated warning horn and present invention
132 conventional warning horn
134 present invention inside warning horn
140 representation of a captured computer screen frame
142 type-1 predetermined switching characteristics setup
144 type-1 number of siren driver pulses parameter
146 type-1 time window of siren driver pulses parameter
148 silent type-1 duration of siren driver pulse parameter
150 type-2 predetermined switching characteristics setup
152 type-2 duration of siren driver pulse parameter
160 type-3/4 predetermined switching characteristics setup
162 type-3/4 number of siren driver pulses parameter
164 type-3/4 time window of siren driver pulses parameter
166 silent type-3/4 duration of siren driver pulse parameter
168 siren power interruption delay parameter
170 timer
172 switching characteristics table
174 siren driver on-times and siren driver off-times or timestamps
176 initialize and start timer
178 wait for siren driver to turn on
180 record on-event timestamp
182 check for false alarm condition
184 loop if siren driver on
186 record off-event timestamp
188 branch on false alarm condition
190 silence siren
192 turn on light and tone generator
194 wait for siren driver to turn off
196 enable indicator light and tone to activate every minute
198 reconnect siren to siren driver
200 type-1 conditions
202 type-2 conditions
204 type-3/4 conditions
210 predetermined switching characteristics memory

DETAILED DESCRIPTION WITH REFERENCE TO THE DRAWINGS

Reference will now be made in detail to a preferred embodiment and alternate embodiments of the present invention, examples of which are illustrated in the accompanying drawings. While the invention will be described in conjunction with these preferred and alternate embodiments, it will be understood that they are not intended to limit the invention to these embodiments. On the contrary, the invention is intended to cover alterative, modifications, and equivalents, which may be included within the spirit and scope of the invention as defined by the claims.

FIG. 1—Description of Parts and Operation

Referring initially to FIG. 1, there is shown a conventional alarm system with the present invention installed. A block representation of the present invention 30 is shown installed between an alarm system siren output or siren driver 18 and a siren 24. Three signals interconnect siren driver 18, invention 30, and siren 24. Firstly, a ground signal 22 connects to siren driver 18, invention 30, and siren 24. Secondly, an alarm system siren output signal or siren driver power signal 20 is output from siren driver 18 and runs to invention 30. Finally, a siren power signal 28 is output from invention 30 and runs to siren 24.

A power supply 10 provides power to a control unit 12. Control unit 12 consists of data processing hardware and is armed or disarmed by a keypad 14. When an alarm system operator uses keypad 14 to arm control unit 12 the control unit 12 monitors the output of a sensor block 16. Sensor block 16 may be comprised of one or more motion sensors, window breakage sensors, vibration sensors, sensors that detect the opening of doors and windows, and the like.

When sensor block 16 detects a change in its monitored conditions, indicating that a break-in may be in progress, it informs control unit 12 and control unit 12 is triggered. When triggered, control unit 12 turns on siren driver 18, which sends electrical power down siren driver power signal 20, through invention 30, to siren power signal 28. Siren 24 sounds to inform neighbors and authorities of a break-in in progress. Unless an operator disarms control unit 12 by entering a unique code into keypad 14, control unit 12 will remain triggered and siren 24 will continue sounding. This sounding will continue until a timer 26 determines that control unit 12 has been triggered for a preset maximum period of time and resets the alarm system. This resetting places control unit 12 back in an armed state and causing siren driver 18 to turn off, which subsequently turns off siren 24.

Invention 30 normally connects siren driver power signal 20 and siren power signal 28 together such that siren 24 will sound whenever siren driver 18 is turned on. When invention 30 determines, through monitoring siren driver power signal 20, that siren 24 has sounded for an extended period of time or has sounded frequently, it disconnects siren power signal 28 from siren driver power signal 20. When disconnected, siren 24 will no longer sound when siren driver 18 is turned on. Invention 30 will reconnect siren power signal 28 to siren driver power signal 20 when it has determined, through monitoring siren driver power signal 20, that siren driver 18 has turned off and the false alarm condition has ended. In this way, invention 30 will permit siren driver 18 to sound siren 24 during subsequent legitimate break-ins when there is not a false alarm.

In order to fully understand the operation of the present invention, it is advantageous to discuss in detail the causes of the four types of false alarms that the invention is able to detect and suppress.

FIG. 1—Description of Type-1 False Alarm

The first type of false alarm that causes extended sounding of siren 24 and is detected and prevented by invention 30 is a malfunctioning sensor block 16. One or more of its sensors repeatedly and continuously informs control unit 12 of a change in its monitored conditions. Control unit 12 will trigger, sounding siren 24, until timer 26 rearms control unit 12 and siren 24 is silenced. But malfunctioning sensor block 16 will immediately retrigger control unit 12, causing siren 24 to sound once again. Siren 24 will sound for a period of time, go silent momentarily, and then repeat this cycle indefinitely. The silent intervals of siren 24 will typically only be a maximum of several seconds in duration. Once this first type of false alarm is detected by invention 30, invention 30 will disconnect siren power signal 28 from siren driver power signal 20, silencing siren 24.

FIG. 1—Description of Type-2 False Alarm

The second type of false alarm that causes extended sounding of siren 24 and is detected and prevented by invention 30 is a malfunctioning of control unit 12 or siren driver 18. The malfunction will cause siren driver 18 to turn-on and remain on. Timer 26 is not able to prevent siren 24 from sounding continuously. Once this second type of false alarm is detected by invention 30, invention 30 will disconnect siren power signal 28 from siren driver power signal 20, silencing siren 24.

FIG. 1—Description of Type-3/4 False Alarm

The third and fourth types of false alarm that cause extended sounding of siren 24 and are detected and prevented by invention 30 are repeated and intermittent triggerings of control unit 12 by sensor block 16. This is caused by a malfunctioning of sensor block 16 or accidental sensor triggering of the sensors in sensor block 16. Control unit 12 will trigger, sounding siren 24, until timer 26 rearms control unit 12 and siren 24 is silenced. But sensor block 16 will retrigger control unit 12, after siren 24 has been silent for an extended period of time, causing siren 24 to sound once again. Siren 24 will sound for a period of time, go silent for a period of time, and then repeat this cycle indefinitely. The silent intervals of siren 24 will typically range from several minutes to several hours in duration. Once this third or fourth type of false alarm is detected by invention 30, invention 30 will disconnect siren power signal 28 from siren driver power signal 20, silencing siren 24.

FIG. 2A

Figure 2A:
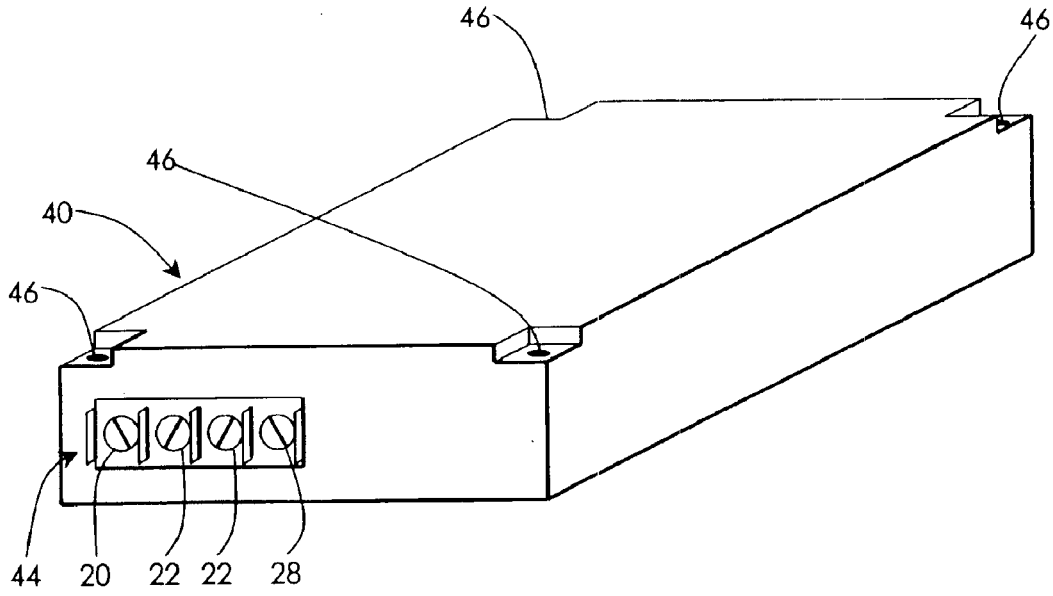
FIG. 2A is a perspective view of a box type configuration of a preferred embodiment of present invention.

Referring now to FIG. 2A, there is shown a perspective view of a basic box type configuration 40 of the preferred embodiment of the present invention. Electronic circuits of the invention, which include a plurality of electronic parts, are contained within basic box type configuration 40. A push-type or screw-type terminal strip four-pin alarm system connector 44 includes a connection to siren driver power signal 20 and siren power signal 28, as well as two connections to ground signal 22. Two connections are provided for ground signal 22 instead of just one in order to simplify the process of installing the present invention into an alarm system, but the present invention is not limited to this configuration. Basic box type configuration 40 is mounted to a mounting surface by using screw mounting holes 46 or by using strong adhesives.

Figure 2B:
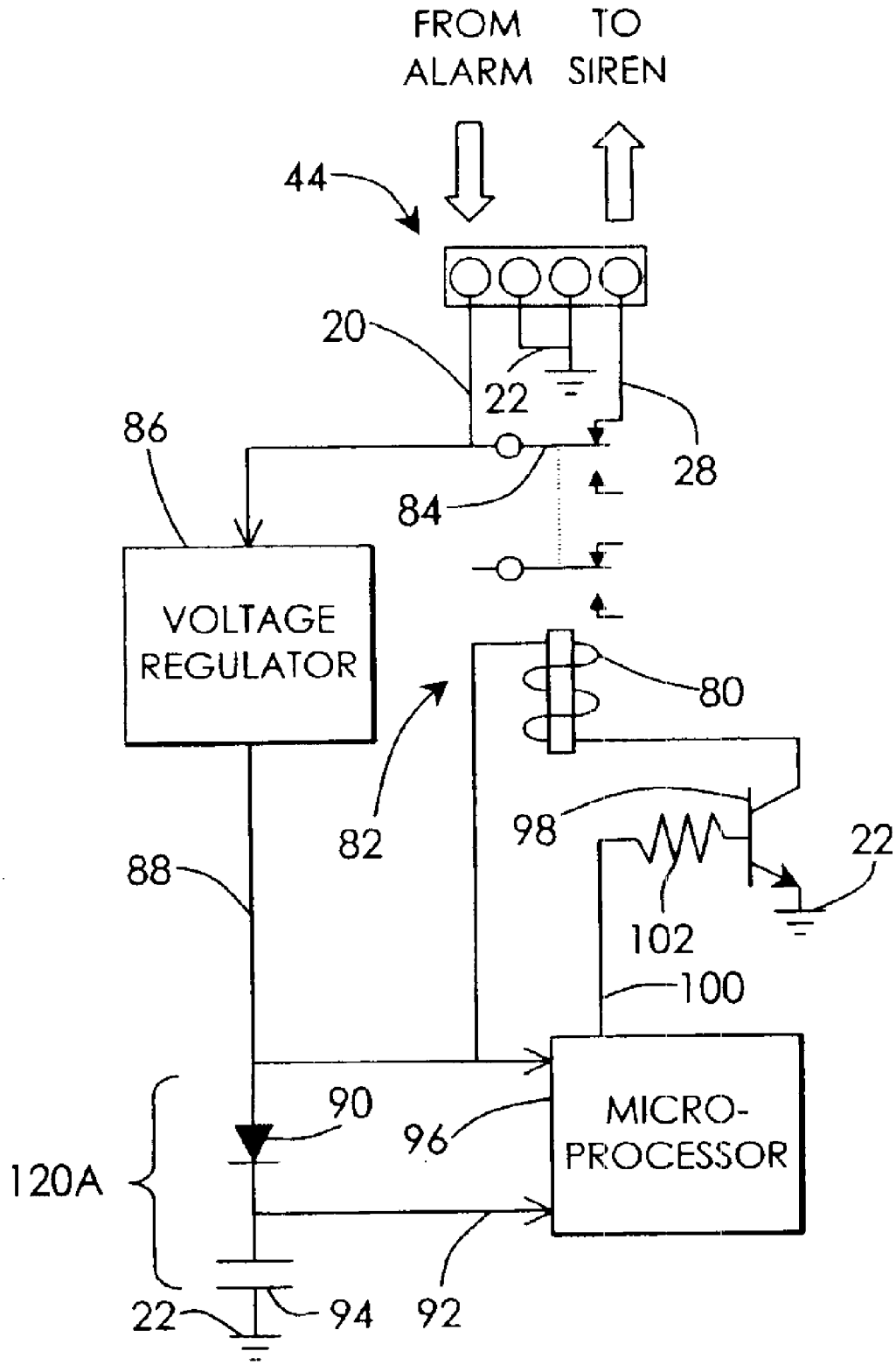
FIG. 2B is a schematic diagram of the preferred embodiment of the present invention.

FIG. 2B—Description of Parts

Referring now to FIG. 2B, there is shown a schematic diagram of the preferred embodiment of the present invention. When a relay coil 80 in a mechanical relay 82 is energized, a relay switch 84 is opened, disconnecting siren power signal 28 from siren driver power signal 20. When relay coil 80 is not energized, relay switch 84 is closed. Relay switch 84 is capable of switching large current loads, up to 5 amps at a minimum of 15 volts, and is thus capable of supplying and switching electrical current to a plurality of commercially available warning sirens, bells, or horns. These warning sirens typically consume from 50 milliamperes to several amperes of current at 6 to 15 volts direct current. The preferred embodiment of the present invention does not limit relay 82 to be mechanical. A solid-state electronic switch or similar electrically controlled switch may be used in place of a mechanical relay. But a mechanical relay naturally provides electrical isolation between its coils and switches, which is useful in protecting delicate electronics from lightening strikes and other electrical voltage surges.

Siren driver power signal 20 may range from 6 to 15 volts DC, relative to ground signal 22, which is the conventional voltage range used by commercially available sirens and alarm systems. A voltage regulator 86 converts siren driver power signal 20 to a fixed voltage power signal 88, which is equal to 5 volts DC relative to ground signal 22 but is not limited to this specific voltage. A diode 90 only allows electrical current to flow in one direction, from fixed voltage power signal 88 to a system power signal 92. This current flow supplies operating electrical power to an electronic timer, digital logic block, gate array, or microprocessor 96. Diode 90 is a schottky-type low voltage drop diode with reverse leakage current under 2 microamperes, but may be any standard rectifying diode. This low reverse leakage current minimizes charge loss on a large capacitor 94.

Large capacitor 94 has a capacitance of 1.5 farads, but is not limited to this size and may range from under 1 millifarad to several farads in capacity. Diode 90 and large capacitor 94 form a charged capacitor power supply 120A. Charged capacitor power supply 120A is not limited to this configuration and may use other components to charge and retain charge on large capacitor 94. The higher the capacitance of large capacitor 94, the longer microprocessor 96 is able to run from the stored electrical charge of large capacitor 94. Microprocessor 96 is a conventional computer that includes a digital processing unit, program and data memory, inputs and outputs, power-on reset circuit, and a computer program. In the preferred embodiment of the present invention, microprocessor 96 is a low power, inexpensive, single-chip microcontroller, but the present invention does not limit it to this embodiment. The microcontroller includes volatile and non-volatile program and data memory and a watchdog timer to reset microprocessor 96 if a malfunction is detected.

Relay coil 80 is energized whenever microprocessor 96 turns on a relay control signal 100 and sends electrical current through a base resistor 102, turning on a transistor 98. Regulator 86 is not required in the preferred embodiment of the present invention if parts such as relay 82, microprocessor 96, and large capacitor 94 are capable of operating with an extended voltage operating range. Because most relays, microprocessors, large capacitors, and other components have specific lower operating voltages, typically 5 volts, regulator 86 is practical to include in the preferred embodiment of the present invention. Voltage regulator 86 also provides overvoltage, surge voltage such as from lightning strikes, and reverse polarity hookup protection for the present invention. This protection may be included on siren driver power signal 20 without the use of regulator 86.

All of the parts used in the present invention are sealed to protect against humidity and moisture and are selected to endure other environmental hazards such as vibration and aging.

FIG. 2B—Description of Operation

Referring again to FIG. 2B, all discussions of voltage levels in this section are relative to ground signal 22 and are direct current, unless otherwise stated. When an alarm system connected to the present invention is not triggered, and has not been triggered for an extended period of time such as a day, siren driver power signal 20 on four-pin alarm system connector 44 is substantially zero volts. Fixed voltage power signal 88 and system power signal 92 are also substantially zero volts, and microprocessor 96 is not operating. Relay coil 80 is not energized and relay switch 84 is closed, connecting siren power signal 28 to siren driver power signal 20.

When the connected alarm system is triggered, siren driver power signal 20 is energized to typically 12 volts and, because relay switch 84 is closed, siren 24 sounds. Regulator 86 uses siren driver power signal 20 to generate 5 volts on fixed voltage power signal 88. Current runs through diode 90 and within a short period of time, from several milliseconds to several tens of seconds, fully charges large capacitor 94. The charging time depends on the capacitance and resistance of large capacitor 94, as well as the current capability of voltage regulator 86. When the voltage level on system power signal 92 is greater than a threshold voltage level within the power-on reset circuit of microprocessor 96, there is sufficient power for microprocessor 96 to automatically come out of reset and begin operating. This threshold level is approximately 2.4 volts, but is not limited to this level and is dependent on the specific microprocessor implementation.

Figure 7:
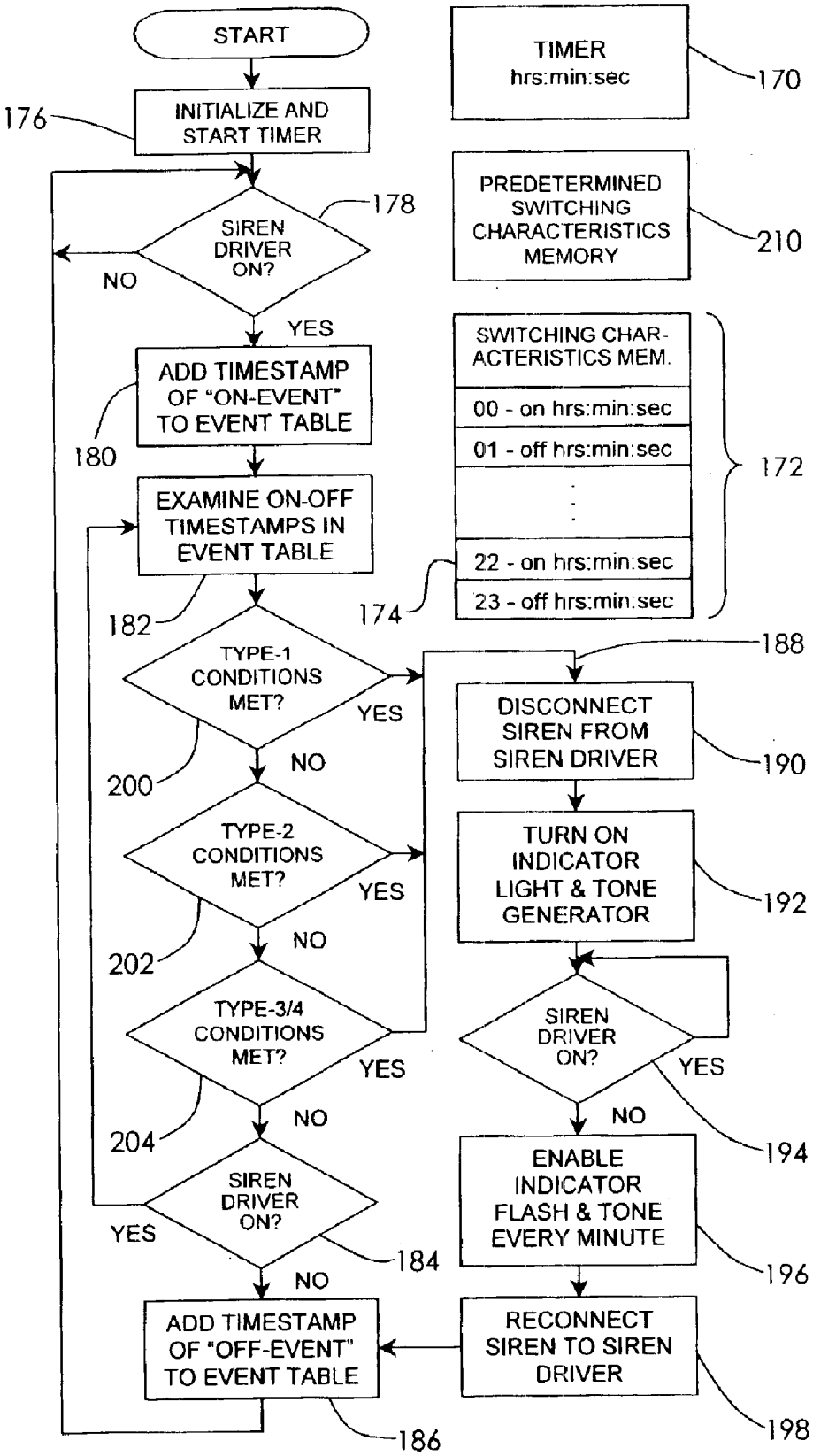
FIG. 7 is a flow chart of the general operation and data structure of the present invention's software.

Microprocessor 96 starts to run and uses the fixed voltage power signal 88 input and the embedded software process of FIG. 7 to determine when the connected alarm system is generating a false alarm. Fixed voltage power signal 88 is seen by microprocessor 96 as 5 volts, or logic high, when the attached alarm system is driving siren 24, and substantially zero volts, or logic low, when the attached alarm system is not driving siren 24. If the attached alarm system stops driving siren 24 for a period of time, from under a second to several hours, fixed voltage power signal 88 will drop to substantially zero volts. But large capacitor 94 will maintain a charge because substantially no electrical current can flow backwards through diode 90, from system power signal 92 to fixed voltage power signal 88.

Because microprocessor 96 is power efficient and uses very little electrical current when operating, on the order of ten microamperes during low activity, it may run for several minutes to a day on the electrical charge stored in large capacitor 94. This time depends on the size of and charge on large capacitor 94, as well as the amount of processing activity on microprocessor 96. The present invention uses a 1.5 farad capacitor, which typically provides over eight hours of run time on microprocessor 96 before large capacitor 94 has discharged below 2.4 volts. Large capacitor 94 will recharge to capacity, or closer to capacity, each time the attached alarm system again turns on siren driver 18. In this manner, microprocessor 96 will continue operating for an extended period of time without the use of a battery or dedicated external power input when the attached alarm system turns siren driver 18 off. This is an important capability because type-1 and type-3/4 false alarms are characterized by siren driver 18 switching on and off repeatedly. Microprocessor 96 must continue to run when siren driver 18 is off to property detect these types of false alarms.

When the software in microprocessor 96 determines that a false alarm is in progress it silences siren 24. It accomplished this by turning on relay control signal 100, which disconnects siren 24, connected to siren power signal 28, from siren driver power signal 20 and turns off siren 24. When the attached alarm system's false alarm eventually ends, either because of human intervention or because a malfunction has naturally stopped occurring, the alarm system's siren driver 18 will turn off. The fixed voltage power signal 88 will have a voltage level of substantially zero volts. Because fixed voltage power signal 88 provides power directly to relay coil 80, relay coil 80 immediately turns off and relay switch 84 closes whenever the alarm system's siren driver 18 turns off. Microprocessor 96, upon seeing fixed voltage power signal drop to zero volts, also turns relay control signal 100 off, ensuring that relay switch 84 will be closed when power is again applied to fixed voltage power signal 88. This ensures that siren 24 and siren driver 18 are connected by default on each new alarm system triggering unless microprocessor 96 determines that siren 24 must be silenced.

When fixed voltage power signal 88 drops to substantially zero volts, because of siren driver 18 turning off, microprocessor 96 will continue to run for several seconds to over eight hours on the remaining charge in large capacitor 94. Its software will analyze any subsequent siren soundings to determine if they are legitimate alarms or false alarms. If they are false alarms, microprocessor 96 will disconnect siren power signal 28 from siren driver power signal 20 and turn off siren 24. If the alarm system does not drive siren driver 18 for an extended period of time, such as several hours, large capacitor 94 will eventually lose its charge and microprocessor 96 will turn off because of a lack of power. If the attached alarm system once again turns on siren 24 after large capacitor 94 has discharged and microprocessor 96 has stopped running, large capacitor 94 will once again recharge. Microprocessor 96 will again start operating and will analyze siren driver power signal 20 input, disconnecting siren 24 if it detects a false alarm. In this preferred embodiment of the present invention, it can be seen that no batteries or external dedicated power inputs are required for the invention to function and that the invention never requires maintenance.

FIG. 3A

Figure 3A:
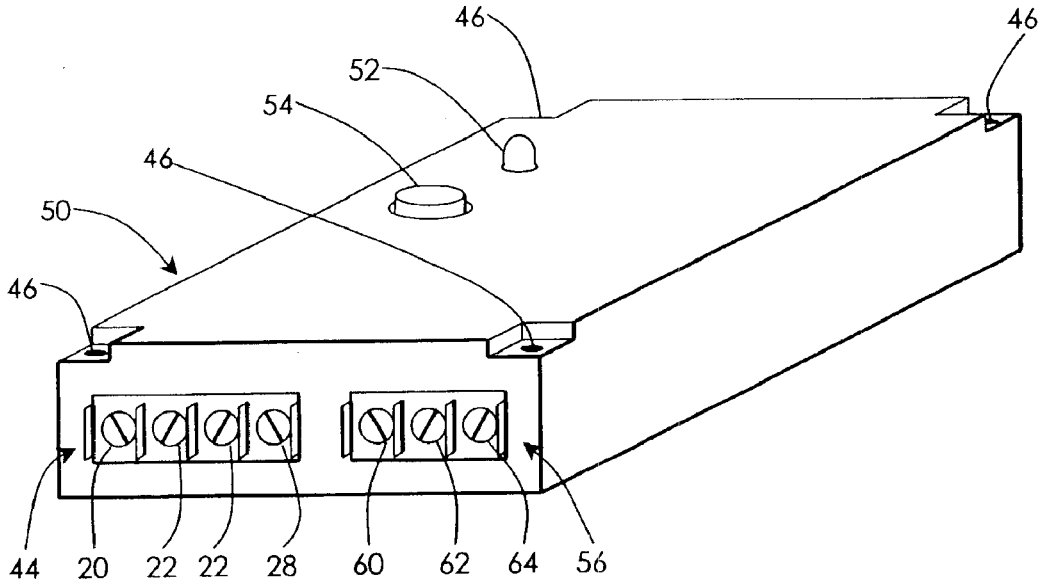
FIG. 3A is a perspective view of a box type configuration of alternate embodiment #1 of the present invention shown with several enhanced user features.

Referring now to FIG. 3A, there is shown a perspective view of an enhanced box type configuration 50 of alternate embodiment #1 of the present invention shown with several enhanced user features. Enhanced box type configuration 50 includes all of the parts of basic box type configuration 40 shown in FIG. 2A: four-pin alarm system connector 44, siren driver power signal 20, ground signal 22, siren power signal 28, and mounting holes 46.

In addition to these parts, a light emitting diode or indicator light 52 illuminates steadily whenever the present invention has disconnected siren power signal 28 from siren driver power signal 20. This indicates to an alarm system's operator that the alarm system is currently generating a false alarm and has had its siren 24 disconnected by the present invention. When in this state, a reset button 54 may be momentarily pressed and released and will result in the resetting and cold software restart of microprocessor 96. This will cause the present invention to disregard the false alarm and reconnect siren power signal 28 to siren driver power signal 20, allowing the alarm system's siren 24 to sound.

Indicator light 52 will flash regularly after an alarm system's false alarm has ended. This informs the alarm system's operator that the alarm system recently generated a false alarm and may need servicing. As an alternative to flashing in the same manner no matter what type of false alarm was detected, indicator light 52 may flash a different pattern depending on the type of false alarm last detected. For example, one flash each minute for type-1 false alarms, a pair of flashes each minute for type-2 false alarms, and three flashes' each minute for type-3/4 false alarms. The alarm operator may momentarily press and release reset button 54 to reset microprocessor 96 and stop indicator light 52 from flashing.

A push-type or screw-type terminal strip three-pin auxiliary connector 56 contains a signal NO 60, a signal AUX 62, and a signal NC 64. When the present invention is not silencing the alarm system's siren 24, signal AUX 62 is disconnected from signal NO 60, or is normally open, and is connected to signal NC 64, or is normally closed. However, when the present invention is silencing the alarm system's siren 24 the reverse condition holds. Signal AUX 62 is connected to signal NO 60 and is disconnected from signal NC 64. In this manner, three-pin auxiliary connector 56 provides a general-purpose normally open or normally closed loop. It can be used to feed back a reset signal to the alarm system, signal remote operators, turn on alternative indicators during a false alarm, or accomplish a plurality of other useful functions. This variety of useful functions depends on the characteristics of the alarm system to which the present invention is attached.

FIG. 3B

Figure 3B:
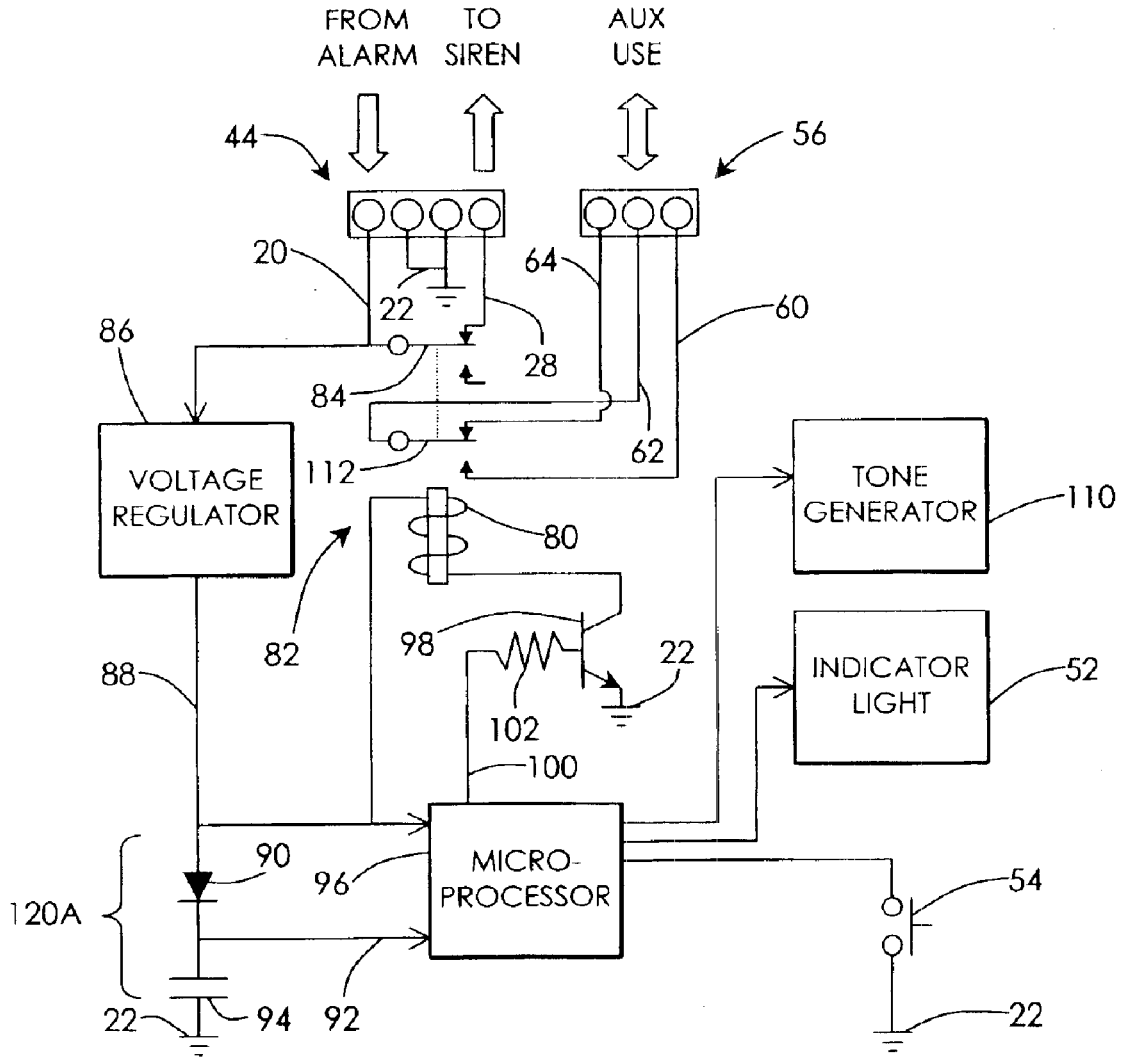
FIG. 3B is a schematic diagram of alternate embodiment #1 of the present invention shown with several enhanced user features.

Referring now to FIG. 3B, there is shown a schematic diagram of alternate embodiment #1 of the present invention shown with several enhanced user features. This embodiment includes all of the parts of the preferred embodiment of the present invention and these parts operate and interact in the same manner as described in the paragraphs associated with FIG. 2B: siren driver power signal 20, ground signal 22, siren power signal 28, four-pin alarm system connector 44, relay coil 80, relay 82, relay switch 84, voltage regulator 86, fixed voltage power signal 88, diode 90, system power signal 92, large capacitor 94, microprocessor 96, transistor 98, relay control signal 100, base resistor 102, and charged capacitor power supply 120A.

In addition to these parts, microprocessor 96 causes indicator light 52 to illuminate steadily and a speaker, beeper, piezo element, or tone generator 110 to sound a steady tone whenever microprocessor 96 has disconnected siren power signal 28 from siren driver power signal 20. This indicates to the alarm system's operator that the alarm system is currently generating a false alarm and has had its siren 24 disconnected by the present invention. When in this state, reset button 54 may be momentarily pressed and released and will result in microprocessor 96 to reset. Microprocessor 96 will respond by disregarding the false alarm and reconnecting siren power signal 28 to siren driver power signal 20, allowing the alarm system's siren 24 to sound.

Microprocessor 96 will cause indicator light 52 to flash regularly and tone generator 110 to beep after the alarm system's false alarm has ended. This informs the alarm system's operator that the alarm system recently generated a false alarm and may need servicing. Because power for the indicator light 52 and tone generator 110 is sourced from large capacitor 94 via system power signal 92, it is important that these two parts are low power consumption components. Because they are low power consumption components, the charge on large capacitor 94 will not deplete quickly. Indicator light 52 is a low power LED and tone generator 110 is a low power piezo element. They each draw in the order of 1 milliampere of current when they are on, and are driven only briefly once per minute after a false alarm has ended in order to conserve the charge on large capacitor 94.

The alarm operator may momentarily press and release reset button 54 to stop indicator light 52 from flashing and tone generator 110 to stop beeping. Reset button 54 performs a power on reset of microprocessor 96, extinguishing indicator light 52 and silencing tone generator 110. Pressing reset button 54 also clears the static memory in microprocessor 96 such that all its memory of previous siren soundings is cleared and its search for false alarm conditions is reset.

Three-pin auxiliary connector 56 containing signal NO 60, signal AUX 62, and signal NC 64 provides a genera-purpose normally open or normally closed loop to be used by alarm installers. Switching of these signals is accomplished by using a second relay switch 112 available in relay 82. Signal AUX 62 is connected to signal NO 60 and is disconnected from signal NC 64 only when relay coil 80 is energized. Energizing relay coil 80 both disconnects the siren 24 and changes the state of the signal interconnects on three-pin auxiliary connector 56.

FIG. 4A

Figure 4A:
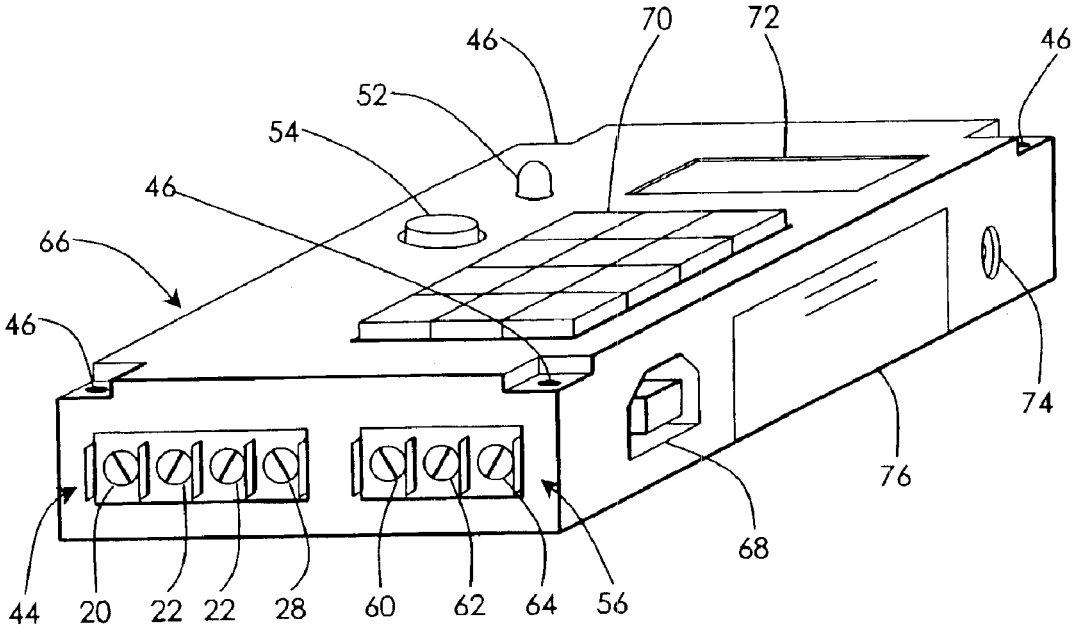
FIG. 4A is a perspective view of a box type configuration of alternate embodiment #2 of the present invention shown with a plurality of enhanced user features.

Referring now to FIG. 4A, there is shown a perspective view of a further enhanced box type configuration 66 of alternate embodiment #2 of the present invention shown with further enhanced user features. Enhanced box type configuration 66 includes all the parts of enhanced box type configuration 50 shown in FIG. 3A: four-pin alarm system connector 44, siren driver power signal 20, ground signal 22, siren power signal 28, mounting holes 46, indicator light 52, reset button 54, three-pin auxiliary connector 56, signal NO 60, signal AUX 62, and a signal NC 64.

In addition to these parts, a computer data connector, standard computer network connector, infrared transceiver, wireless data antenna serial connector, or universal serial bus connector 68 is present. It is used to communicate data between the present invention and a personal computer, allowing an operator or installer to customize certain parameters of the present invention. These parameters define predetermined switching characteristics of siren driver power signal 20, such as duration and number of siren soundings, until siren silencing occurs. Parameter changes and firmware or software upgrades to microprocessor 96 are achieved by sending data from an external network or computer through universal serial bus connector 68. Universal serial bus connector 68 is also used to transmit the current status and history of the states of the present invention to a computer or network. This allows the operator to determine the number and types of false alarms detected by the present invention.

Once parameter or firmware uploads and status downloads are complete, the present invention may perform its siren suppression function with or without the continued use of universal serial bus connector 68. The cable connected to it may be disconnected. In this way, the predetermined operational parameters of the present invention may be customized by an alarm installer's computer before or after the unit is installed in the alarm system.

A parameter adjustment keypad 70 allows an operator or installer to customize certain parameters of the present invention that define predetermined switching characteristics of siren driver power signal 20 required for siren silencing. These parameters include duration and number of siren soundings. A light emitting diode or liquid crystal display 72 provides an operator with visual feedback of the characteristics entered into parameter adjustment keypad 70. It also provides the current status and history of the states of the present invention, such as the number and types of false alarms detected. A direct current or alternating current power connector 74 provides an external electrical power input to the present invention. A battery compartment 76 allows a battery to power the present invention.

FIG. 4B

Figure 4B:
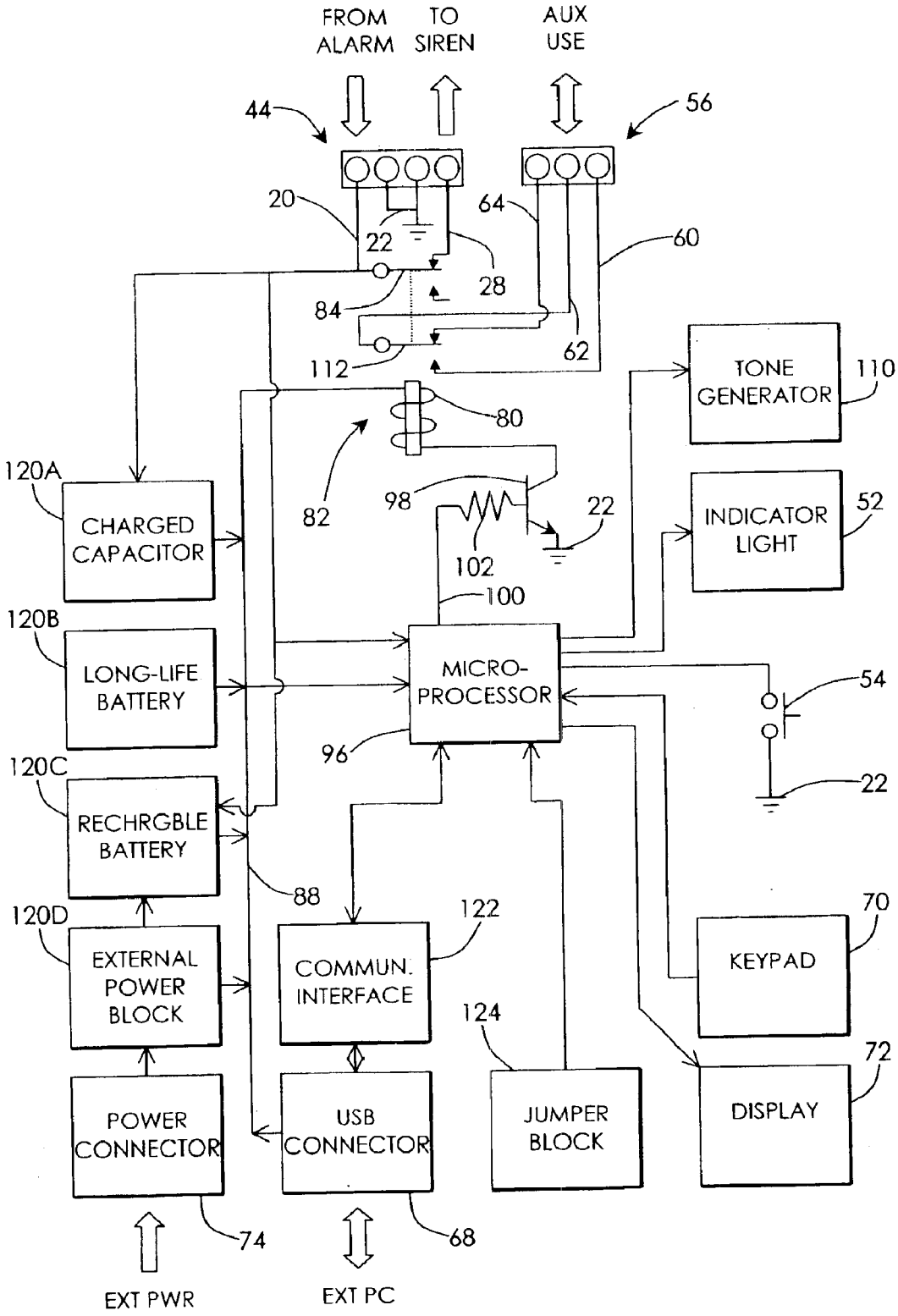
FIG. 4B is a schematic diagram of alternate embodiment #2 of the present invention shown with a plurality of enhanced user features.

Referring now to FIG. 4B, there is shown a schematic diagram of alternate embodiment #2 of the present invention shown with further enhanced user features. This embodiment includes the following parts described in the paragraphs associated with FIG. 3B, which operate and interact in the same manner as the previous description unless otherwise noted: four-pin alarm system connector 44, siren driver power signal 20, ground signal 22, siren power signal 28, indicator light 52, reset button 54, three-pin auxiliary connector 56, signal NO 60, signal AUX 62, signal NC 64, relay coil 80, relay 82, relay switch 84, microprocessor 96, transistor 98, relay control signal 100, base resistor 102, tone generator 110, second relay switch 112, and charged capacitor power supply 120A.

Although the preferred method for providing power to the present invention is through charged capacitor power supply 120A, electrically charged by siren driver power signal 20, the present invention is not limited to this method. Power to fixed voltage power signal 88 may alternatively or additionally be supplied by a long-life battery 120B, a rechargeable battery 120C, an external power block 120D, a universal serial bus connector 68, or similar conventional means of supplying power. Rechargeable battery 120C may be recharged by siren driver power signal 20 or power from power connector 74.

Microprocessor 96 is powered by fixed voltage power signal 88 and is able to determine when the alarm system's siren driver 18 is on or off by examining its siren driver power signal 20 input. External power block 120D sources its power from power connector 74. A communications interface 122 communicates data between microprocessor 96 and universal serial bus connector 68. Communications interface 122 allows a user to customize certain parameters of the present invention that define predetermined switching characteristics required for siren silencing. Communications interface 122 also transmits status of the present invention to an external network or personal computer connected to universal serial bus connector 68. The software of microprocessor 96 includes a communications interface process.

Parameter adjustment keypad 70 and liquid crystal display 72 are connected to microprocessor 96 and allow for alarm silencing parameter adjustment and status display. Microprocessor 96 software interprets keystrokes on parameter adjustment keypad 70 and outputs user data to liquid crystal display 72. A rotary switch, switch block, or jumper block 124 consists of a plurality of electrical switches and is read by connected microprocessor 96. By configuring jumper block 124, the user of the present invention is able to adjust certain parameters of the present invention that define predetermined switching characteristics of siren driver power signal 20. This allows alarm silencing characteristics of the present invention, including duration and number of siren soundings until silencing occurs, to be customized.

FIG. 5

Referring now to FIG. 5, there is shown a perspective view of an integrated warning horn alternate embodiment of the present invention. It combines a conventional siren or warning horn 132 with a present invention inside warning horn 134 to form an integrated warning horn and present invention 130. Siren driver power signal 20 and ground signal 22 run directly from an alarm system into integrated warning horn and invention 130. When present invention inside warning horn 134 detects a false alarm, it turns off conventional warning horn 132. The present invention may also be integrated into an alarm system's control unit 12 or siren driver 18 in a similar fashion, producing a single device which integrates the alarm system and present invention.

FIG. 6—Overview

Referring now to FIG. 6, there is shown a representation of a captured computer screen frame 140 used to set or alter a plurality of software operational parameters of the invention. The term "triggering"is used throughout captured computer screen frame 140 to describe siren driver 18 turning on, where the voltage of siren driver power signal 20 jumps from substantially zero volts to typically 6 to 15 volts direct current. When siren driver 18 eventually turns off, the voltage on siren driver power signal 20 falls again to substantially zero volts. In this manner, triggerings of an alarm system result in signal switching or signal pulses on siren driver power signal 20. Collectively, the software operational parameters define predetermined switching or pulse signal characteristics that are compared with switching or pulse signal characteristics of siren driver power signal 20. The results of this comparison, performed by microprocessor 96, are used to determine when siren 24 must be silenced.

It is useful to include FIG. 6 in order to help the reader to appreciate the detailed operation of the software in microprocessor 96 and the specific switching or pulse signal characteristics of siren driver power signal 20 required to detect false alarms. Captured computer screen frame 140 appears on a computer connected to the present invention using universal serial bus connector 68, or on liquid crystal display 72. It allows the alarm system owner or installer, in the field, to view and configure various parameters that define predetermined switching characteristics of the invention. Alternatively, capture computer screen frame 140 appears on a computer attached to microprocessor 96 during the manufacturing of the present invention. It allows a manufacturer of the product, in a factory, to configure various parameters that define predetermined switching characteristics of the invention.

The ability to configure predetermined switching characteristics is important because the present invention is intended to be added to all types of alarm systems, including automobile alarms, house alarms, and business alarms. Predetermined switching characteristics can be optimized for the specific alarm system, which depend on a plurality of alarm system characteristics. These alarm system characteristics include the alarm system location and type, the types of sensors used, the tolerance to false alarms, and the reliability of the system. For example, an alarm owner may want a house alarm to sound longer than a car alarm before it is silenced by the present invention.

FIG. 6—Description of Type-1 False Alarm

Referring again to FIG. 6, a false alarm type-1 predetermined switching characteristic setup 142 is included. Type-1 false alarms are characterized by siren 24 sounding for a period of time, then going silent for a very short period of time, and repeating this sequence indefinitely. Siren 24 will not be silenced until at least a certain number of alarm system consecutive triggerings have occurred, as defined in a type-1 number of siren driver pulses parameter or consecutive triggerings parameter 144. Siren 24 will not be silenced until at least a certain period of time has elapsed since the first alarm system triggering in the chain of consecutive triggerings. This period of time is defined in a type-1 time window of siren driver pulses parameter or total time from first triggering parameter 146. If the silent time between a consecutive alarm system triggering is greater than the time defined by a silent type-1 duration of siren driver pulse parameter or maximum silent time parameter 148 then the next triggering will not be considered to be part of previous type-1 false alarm triggerings. In this case, the search for type-1 false alarms will reset.

The specific example provided in false alarm type-1 predetermined switching characteristics setup 142 results in the following conditions; the present invention will detect a type-1 false alarm if, and only if, a minimum of 3 triggers have occurred in a period of 6 or more minutes and consecutive triggerings have had a maximum of 10 seconds of silence between them. Once the type-1 false alarm is detected, siren 24 will be silenced. It will remain silenced as long as retriggerings continue to occur and adhere to the conditions defined by false alarm type-1 predetermined switching characteristics setup 142. If these conditions are not met, siren 24 is reconnected to siren driver 18 and microprocessor 96 continues its search and siren silencing of new or other types of false alarms.

FIG. 6—Description of Type-2 False Alarm

Referring again to FIG. 6, a false alarm type-2 predetermined switching characteristics setup 150 is included. Type-2 false alarms are characterized by siren 24 turning on and continuously sounding. Siren 24 will not be silenced until it has sounded continuously for a period of time, as defined by a type-2 duration of siren driver pulse parameter or minimum total time parameter 152. The specific example provided in false alarm type-2 predetermined switching characteristics setup 150 results in the following conditions; the present invention will detect a type-2 false alarm if, and only if, siren driver 18 has been on, without any interruption, for 15 consecutive minutes. Once the type-2 false alarm is detected, siren 24 will be silenced and will remain silenced as long as siren driver 18 remains on. If this condition is not met, siren 24 is reconnected to siren driver 18 and microprocessor 96 continues its search and siren silencing of new or other types of false alarms.

FIG. 6—Description of Type-3/4 False Alarm

Referring again to FIG. 6, a false alarm type-3/4 predetermined switching characteristics setup 160 is included. Type-3/4 false alarms are characterized by siren 24 sounding for a period of time, then going silent for an extended period of time, and repeating this sequence intermittently. Siren 24 will not be silenced until at least a certain number of alarm system consecutive triggerings have occurred. This number is defined in a type-3/4 number of siren driver pulses parameter or minimum number of triggerings parameter 162. Siren 24 will not be silenced unless the triggerings occur within a certain window of time, as defined by a type-3/4 time window of siren driver pulses parameter or time window parameter 164.

If the silent time between a consecutive alarm system triggering is less than the time defined by a silent type-3/4 duration of siren driver pulse parameter or minimum silent time parameter 166 then the next triggering will not be considered to be a new triggering. It will be considered to be part of the previous type-3/4 false alarm triggering and will be counted as a single triggering. Finally, when a type-3/4 false alarm has been detected, each new alarm system triggering may not be silenced immediately; rather, it is silenced according to a siren power interruption delay parameter 168. When siren 24 sounds, after a series of intermittent siren soundings, it may be an actual break-in and not a false alarm. Because of this fact, it may be useful to sound siren 24 for a limited period of time rather than immediately silence it.

The specific example provided in false alarm type-3/4 predetermined switching characteristics setup 160 results in the following conditions; the present invention will detect a type-3/4 false alarm if, and only if, a minimum of 4 triggers have occurred in a window of 8 hours and each triggering has had a minimum of 10 seconds of silence between them. Once the type-3/4 false alarm is detected, siren 24 will be silenced 15 seconds after each new alarm system triggering and will remain silenced. Each subsequent triggering will be silenced after 15 seconds of sounding as long as the subsequent triggering adheres to the conditions defined by false alarm type-3/4 predetermined switching characteristics setup 160. If these conditions are not met, siren 24 is reconnected to siren driver 18 and microprocessor 96 continues its search and siren silencing of new or other types of false alarms.

FIG. 6—Summary

Referring again to FIG. 6, it is critical to note that the search for type-1, type-2, and type-3/4 false alarms occur concurrently. Siren 24 will be silenced by the present invention if one of more of these types of false alarms are detected. It is also important to note that the present invention does not require all three types of detection processes to be running in microprocessor 96. Alternate embodiments of the present invention include any one, two, or three of these processes operating in microprocessor 96 at any given time. The present invention does not limit the alarm detection parameters to the specific types and values provided in FIG. 6. On the contrary, the invention is intended to cover alternatives, modifications, and equivalents, which may be included within the spirit and scope of the invention as defined by the claims.

FIG. 7—Description of Parts

Referring now to FIG. 7, there is shown a flow chart of the general operation and data structure of the present invention's software running in microprocessor 96. A timer 170 counts time when microprocessor 96 first begins running after receiving power or after pressing reset button 54 causes a power on reset. Timer 170 is an independent free-running counter driven by a clock within microprocessor 96 and counts, without interruption, starting at 0 hours, 0 minutes, and 0 seconds. A switching characteristics table 172 is a data memory table within microprocessor 96 that is used to record a plurality of siren driver on-times and siren driver off-times or timestamps 174. Timestamps 174 record every siren on-event and off-event that occurs from the moment that microprocessor 96 first begins running. Collectively these events represent the switching characteristics of siren driver power signal 20.

Each timestamp 174 in switching characteristics table 172 consists of two bytes, which is the required memory to store a maximum timestamp value of 15 hours, 59 minutes, and 59 seconds. Four bits store the hours, six bits store the minutes, and six bits store the seconds. Switching characteristics table 172 is 48 bytes in length and is capable of storing 12 on-event timestamps and 12 off-event timestamps. Each new timestamp 174 is added to switching characteristics table 172. Once switching characteristics table 172 overflows, the newest timestamp replaces the oldest timestamp. The present invention is not limited to the specific switching characteristics table size and timestamp implementation scheme outlined in this paragraph.

FIG. 7—Description of Operation

Referring again to FIG. 7, when microprocessor 96 first begins running, it initializes the variables in the system and starts timer 170 counting 176. Siren power signal 28 is connected to siren driver power signal 20, indicator light 52 is extinguished, and the tone generator 110 is silenced during initialization 176. The program then loops indefinitely until siren driver power signal 20 is determined to be on 178. Once on, the current value of timer 170 is written to an on-event timestamp in switching characteristics table 172; switching characteristics table 172 records the exact second that siren driver power signal 20 is detected to be on 180. The program then examines the set of timestamps 174 stored in switching characteristics table 172 to determine if conditions satisfy any of the four types of false alarms 182. Switching characteristics table 172 is compared with parameters in a non-volatile predetermined switching characteristics memory 210. The program determines if switching characteristics of siren driver power signal 20 are equivalent to one or more of the predetermined switching characteristics for the four types of false alarms 182.

If none of the false alarm conditions are satisfied the program will loop indefinitely, waiting for either a false alarm condition to be satisfied or for siren driver power signal 20 to turn off 184. If siren driver power signal 20 turns off before a false alarm condition is satisfied, the current value of timer 170 is written to an off-event timestamp in switching characteristics table 172 186. However, if a false alarm condition is satisfied before siren driver power signal 20 turns off, the program branches 188. Siren power signal 28 is then disconnected from siren driver power signal 20, and the siren is silenced 190. Indicator light 52 and tone generator 110 are turned on 192 to warn an alarm operator that siren 24 is being silenced, and the invention waits for siren driver 18 to turn off 194.

Once siren driver power signal 20 turns off, indicator light 52 and tone generator 110 are set to indefinitely turn on briefly once per minute 196 and siren power signal 28 is reconnected to siren driver power signal 20 198. Indicator light 52 and tone generator 110 warn the alarm operator that a false alarm occurred. Indicator light 52 and tone generator 110 will only stop turning on once per minute when the power input of microprocessor 96 drops below an operational threshold or reset button 54 is pressed, resulting in a power on reset. Finally, the turning off of siren 24 is once again recorded in switching characteristics table 172 by recording an off-event timestamp 186. The invention then waits for the next occurrence of the siren driver 18 turning on 178.

When microprocessor 96 is in operation, much of its time is spent waiting for siren driver 18 to turn on 178. Waiting for siren driver 18 to turn on 178 is interrupt-driven in the preferred embodiment of the present invention, allowing microprocessor 96 to shut down all non-critical operations and hardware, except for timer 170. This further decreases power consumption of low-power consumption microprocessor 96 allowing microprocessor 96 to run for an extended period of time from the charge on large capacitor 94.

FIG. 7—Description of False Alarm Types

Referring again to FIG. 7, the switching characteristics searched for in switching characteristics table 172 and required for the four types of false alarms 182 were fully described in the paragraphs for FIG. 6. Specific parameter example values were provided, and are briefly restated. Type-1 conditions 200 are satisfied if, and only if, a minimum of 3 triggers have occurred in a period of 6 or more minutes and each triggering has had a maximum of 10 seconds of silence between them. Type-2 conditions 202 are satisfied if, and only if, siren driver 18 has been on, without any interruption, for 15 consecutive minutes. And type-3/4 conditions 204 are satisfied if, and only if, a minimum of 4 triggers have occurred in a window of 8 hours and each triggering has had a minimum of 10 seconds of silence between them. Once the type-3/4 false alarm is detected, siren 24 will be silenced 15 seconds after each new alarm system triggering.

These are only example parameter values, and the present invention is not limited to these parameter values. Variations of the predetermined switching characteristics used to detect equivalent types, similar types, or other types of false alarms are included in the scope of the present invention.

Conclusion, Ramifications, and Scope

Thus the reader will see that the automatic siren silencing device for false alarms provides an effective means of automatically silencing siren 24 and minimizing noise pollution when false alarms are being generated by an alarm system. It will detect any one of the four common types of false alarms described herein. After a false alarm has ended, either because of human intervention or because the conditions causing the false alarm have changed, the device will reconnect siren 24 to the alarm system. This will allow subsequent legitimate alarms to sound siren 24. It is important to emphasize that the present invention will not prevent properly functioning alarm systems from detecting and signaling actual break-ins.

It can be seen that the device can be used with almost all types of existing alarm systems, including home and car alarms, and is easy to install. In the preferred embodiment, it requires no maintenance and needs no battery replacement or power supply inputs. Because the present invention's electronic components are inexpensive and few in number, it can be inexpensively manufactured.

In alternate embodiments, the present invention informs the user of an existing or recent false alarm and provides status on the specific type of false alarm detected. This allows the user to take appropriate measures such as having the alarm system properly serviced. The user can customize the false alarm detection parameters for the four types of false alarms described herein. The device includes a general-purpose normally open or normally dosed switch that switches when a false alarm is detected. This switch can be used by an alarm installer for a variety of useful purposes within the alarm system, such as feeding back a reset signal to the alarm system or signaling remote operators. The present invention may be integrated with a horn into a single unit such that the horn automatically turns off when any of the four types of false alarms are detected. Finally, the device may be integrated with an alarm system controller such that the siren output of the controller automatically turns off when any of the four types of false alarms are detected.

While the present invention has been described herein with respect to the exemplary embodiments and the best mode for practicing the invention, it will be apparent to one of ordinary skill in the art that many modifications, improvements and subcombinations of the various embodiments, adaptations and variations can be made to the invention without departing from the spirit and scope thereof.

Thus the scope of the invention should be determined by the appended claims and their legal equivalents, rather than by the examples given.

What is claimed is:

1. An automatic siren silencing device for false alarms, for use in an alarm system having a siren driver and a siren, said siren driver powering said siren, comprising:

a means for powering said device;

a means for interrupting power from said siren driver to said siren;

a means for maintaining memory of predetermined switching characteristics;

logic means for determining whether switching characteristics of said siren driver are equivalent to said predetermined switching characteristics;

said logic means being operatively connected to said siren driver for detecting said switching characteristics;

said logic means also being controllably connected to said means of interrupting power;

said logic means interrupting power from said siren driver to said siren when said logic means determines that said switching characteristics are equivalent to said predetermined switching characteristics.

2. The device as recited in claim 1, wherein said means for powering is a means for storing electrical charge, said means for storing electrical charge being electrically coupled to said siren driver, said means for storing electrical charge being charged from the power of said siren driver whereby a dedicated external power supply or a battery requiring replacement is not required for said device to operate.

3. The device as recited in claim 2, wherein said means for storing electrical charge is a capacitor.

4. The device as recited in claim 1, wherein said means for powering is the signal from said siren driver.

5. The device as recited in claim 1, wherein said means for powering is a power input connector whereby power may be supplied by a battery or a power supply drawing power from a standard alternating current electrical outlet.

6. The device as recited in claim 1, wherein said means for interrupting power is a relay.

7. The device as recited in claim 1, wherein said predetermined switching characteristics include a plurality of switching parameters.

8. The device as recited in claim 7, wherein said plurality of switching parameters includes a number of siren driver pulses value.

9. The device as recited in claim 7, wherein said plurality of switching parameters includes a duration of siren driver pulse value.

10. The device as recited in claim 7, wherein said plurality of switching parameters includes a time window of siren driver pulses value.

11. The device as recited in claim 7, wherein said plurality of switching parameters includes a siren power interruption delay value.

12. The device as recited in claim 1, wherein said switching characteristics include a plurality of siren driver on-times and siren driver off-times whereby duration of siren driver pulses and a count of said siren driver pulses can be determined by said logic means.

13. The device as recited in claim 1, wherein said switching characteristics include a duration of siren driver pulse value.

14. The device as recited in claim 1, wherein said logic means is a computer.

15. The device as recited in claim 1, further including a user interface means for user changeable program setting of said predetermined switching characteristics whereby false alarm detection characteristics of said device can be customized by a user.

16. The device as recited in claim 15, wherein said user interface means is a means of operatively connecting said device to a general purpose computer whereby said general purpose computer sends said predetermined switching characteristics to said means for maintaining memory.

17. The device as recited in claim 16, wherein said means of operatively connecting is a serial interface connector.

18. The device as recited in claim 15, wherein said user interface means is a plurality of switches.

19. The device as recited in claim 1, further comprising means for displaying operational status of said device, said means for displaying operatively coupled and responsive to said logic means, said operational status established according to said determination of equivalence between switching characteristics and said predetermined switching characteristics.

20. The device as recited in claim 19, wherein said means for displaying is a plurality of indicator lights.

21. The device as recited in claim 1, further comprising means for generating an audible signal in increments of varying duration, said means for generating operatively coupled and responsive to said logic means, said increments of varying duration established according to said determination of equivalence between switching characteristics and said predetermined switching characteristics.

22. The device as recited in claim 21, wherein said means for generating is a piezo element.

23. The device as recited in claim 1, further including a means to reset said logic means whereby memory of said switching characteristics is reset and said logic means reconnects power from said siren driver to said siren.

24. The device as recited in claim 1, further including a relay, a means for a user of said device to connect to the switch of said relay, said logic means controllably connected to the coil of said relay, the switch of said relay is switched by said logic means whenever power from said siren driver to said siren is interrupted by said device whereby the switch of said relay forms a normally open or normally closed loop that may be used by said user for a plurality of miscellaneous useful functions in said alarm system.

25. The device as recited in claim 1, further including a warning horn, said warning horn electrically connected to said means for interrupting power whereby said device includes said warning horn in an integrated unit that automatically silences when said integrated unit detects a false alarm.

26. The device as recited in claim 1, further including an alarm system controller, said alarm system controller electrically connected to said means for interrupting power whereby said device includes said alarm system controller in an integrated unit that automatically stops driving said siren when said integrated unit detects a false alarm.

27. A siren disrupter for false alarms, for use in an alarm system having a siren driver and a siren, comprising:

a relay having a relay coil and a relay switch;

said siren derives power from said siren driver through said relay switch;

said relay switch disconnects power to said siren when said relay coil is activated;

a computer is controllably connected to said relay coil;

said computer is operatively connected to said siren driver to sense the signal of said siren driver;

said computer compares pulse signal characteristics of said siren driver with predetermined pulse signal characteristics;

said predetermined pulse signal characteristics stored in a memory;

said computer disconnects power to said siren when said computer determines that said pulse signal characteristics are equivalent to said predetermined pulse signal characteristics.

28. The siren disrupter as recited in claim 27, further including a capacitor, said capacitor being electrically connected to said siren driver, said capacitor being charged from the power of said siren driver, said capacitor powering said computer.

29. The siren disrupter as recited in claim 27, further including a user interface means for user changeable program setting of said predetermined pulse signal characteristics.

30. A method of automatically interrupting power from a siren driver to a siren in an alarm system in the event of a false alarm, the method comprising the steps of:

continuously sensing the signal of said siren driver;

comparing pulse signal characteristics of said siren driver with predetermined pulse signal characteristics to determine if any of said predetermined pulse signal characteristics are met;

interrupting power from said siren driver to said siren if said predetermined pulse signal characteristics are met.

31. The method in claim 30, wherein said predetermined pulse signal characteristics include a number of pulses value.

32. The method in claim 30, wherein said predetermined pulse signal characteristics include a pulse duration value.

33. The method of claim 30, wherein said method further comprises the step of generating an alarm if any of said predetermined pulse signal characteristics are met whereby a user is notified of a false alarm with indicator lights or a tone generator.

34. The method of claim 30, wherein said method further comprises the step of reconnecting power from said siren driver to said siren when said predetermined pulse signal characteristics are no longer met.

35. The method of claim 30, wherein said method further comprises the step of being programmed by a user.

* * * * *